US006860733B2

(12) United States Patent
Zhang

(10) Patent No.: US 6,860,733 B2
(45) Date of Patent: Mar. 1, 2005

(54) SAFETY GAS LIGHTER WITH A RATCHET-PAWL MECHANISM

(75) Inventor: Fu Quan Zhang, Guangxi Autonomy (CN)

(73) Assignee: L & L Lighter Corp., Alhambra, CA (US)

( * ) Notice: Subject to any disclaimer, the term of this patent is extended or adjusted under 35 U.S.C. 154(b) by 0 days.

(21) Appl. No.: 10/641,119

(22) Filed: Aug. 15, 2003

(65) Prior Publication Data

US 2004/0033462 A1 Feb. 19, 2004

Related U.S. Application Data

(63) Continuation-in-part of application No. 10/125,634, filed on Apr. 19, 2002.

(30) Foreign Application Priority Data

Apr. 20, 2001 (CN) ..... 01235523 U

(51) Int. Cl.[7] ..... F23D 11/36
(52) U.S. Cl. ..... 431/153; 431/277; 431/140

(58) Field of Search ..... 431/153, 277, 431/140, 141

(56) References Cited

U.S. PATENT DOCUMENTS 3,827,852 A * 8/1974 Chevallier ..... 431/254
5,468,144 A * 11/1995 Iwahori ..... 431/254
5,655,902 A * 8/1997 Doucet ..... 431/153
5,846,069 A * 12/1998 Sher ..... 431/153
6,099,296 A * 8/2000 Wang ..... 431/153

* cited by examiner

*Primary Examiner*—Alfred Basichas
(74) *Attorney, Agent, or Firm*—Rabin & Berdo, P.C.

(57) ABSTRACT

A safety gas lighter with a ratchet-pawl mechanism comprises a lighter body, a fuel supply means, an ignition means and a safety device. The safety device includes a pivoting axle, an internal ratchet rotating together with the axle and being attached to one side of the axle, a pawl member having engage pawls, being selectively engaged with ratchet teeth of ratchet and also having two cylinders protruding from the pawl member, and a safety hood, one side of which is installed by fitting coupling holes over cylinders and one end of the axle and another side of which on another end of the axle.

3 Claims, 4 Drawing Sheets

SAFETY GAS LIGHTER WITH A RATCHET-PAWL MECHANISM

RELATED APPLICATION

This is a Continuation-in-part of U.S. patent application, Ser. No. 10/125,634 filed Apr. 19, 2002, and which claimed priority from Chinese Patent Application No. 01235523.2 filed Apr. 20, 2001.

FIELD OF THE INVENTION

The present invention relates to a gas lighter having a safety device, which is particularly suitable for use in a conventional lighter by means of the spark wheel being driven to rotate against the flint for generating a spark to ignite. More particularly, it relates to a safety gas lighter with a ratchet-pawl mechanism.

BACKGROUND OF THE INVENTION

At the present time, such some conventional lighters have become very popular. One of the reasons for their popularity is that their structure is simple, the operation is reliable, it is easy to ignite and production costs are low. However, such conventional lighters also bear the drawbacks as follows.

Their safety is not sufficient. Most such lighters are designed to be easily operated by children so that it broods the danger that, if it is accidentally lighted, or if a child plays with it, a hellish catastrophe can occur. In addition, since such igniting manipulation requires the operator's thumb to rotate the spark wheel to ignite the lighter, it is easy to suffer injuries to the operator's hand and get his hand dirty.

Therefore, there is a need to incorporate a safety feature with conventional gas lighters to make them difficult to ignite by children. One typical method is to incorporate a rotatable wheel hood having a safety position and an activation position, which is placed over the striker. Such a design is able to hinder the rotation of the striker wheel especially by children to prevent it from striking the flint stone to give out spark. An example of such mechanism is shown in U.S. Pat. No. 5,846,069.

However, it is not a wise way of trying to lock the striker. Some smart or brilliant children may release such a mechanism and ignite the fire because there is no any lockable mechanism in direction ①. As long as the wheel hood is put off, striker wheel edge can be rotated so as to create a spark. Obviously, the present invention provides a safety gas lighter with a ratchet-pawl mechanism, which is a better way to prevent the children from igniting a lighter and is greatly different from U.S. Pat. No. 5,846,069.

Regarding the ratchet-pawl mechanism, it consists of a ratchet wheel and a pawl and permits motion in only one direction. Such a mechanism is especially in lifting devices and some hand tools. However, Iwahori in U.S. Pat. No. 5,468,144 also discloses a ratchet-pawl mechanism. But in Iwahori's invention, its ratchet-pawl mechanism only use to rotate the rotary file 4 in one direction, whereby producing sparks.

As far as the present invention is concerned, the ratchet-pawl mechanism according to the present invention has the following two functions: a) the safety hood 20 needs to be transferred to an activation position; and b) under the condition a), the safety hood 20 needs to be pressed back, whereby simultaneously rotating the striker wheel in order to give out sparks. Therefore, even if the person skilled in the art did transfer the teaching of U.S. Pat. No. 5,468,144 to the rotatable wheel hood of U.S. Pat. No. 5,846,069, the transfer would still not result in the safety hood of the present invention.

SUMMARY OF THE INVENTION

The present invention is intended to overcome the above described disadvantages of the conventional technique.

Therefore, it is an object of the present invention to provide a lighter having a safety device that protects children from accidental ignition while also allowing convenient adult usage.

In achieving the above object, on the basis of the conventional gas lighters, the lighter according to the present invention further comprises an internal ratchet, a pawl, and a safety hood therein a cavity of the internal ratchet provides an internal toothed ring; the pawl is in the form of "S" and on which there are two projecting cylinders; a hole is established at the centre of the pawl; the safety hood is in the form of a semicircle on which there are two opened legs and two fitting coupling holes on one side; the internal ratchet and the spark wheel are side by side mounted on the pivoting axle which passes through the hole of the pawl so that the pawl is located in the internal toothed ring of the internal ratchet; the two end tips of the pawl and the teeth of the internal ratchet are engaged, whereby forming an one-way drive mechanism; the spark wheel, the internal ratchet and the pawl are covered by the safety hood therein two opened legs of the safety hood are stuck into two ends of the pivoting axle and the two projecting cylinders of the pawl are put on two small holes of the safety hood; and the pivoting axle is mounted on support frame.

Accordingly, the above mentioned object is accomplished in the present invention by means of the cooperation of the internal ratchet, the pawl, the safety hood and the spark wheel. As compared with the prior art, the lighter in accordance with the present invention is easily operated by adults while still being significantly resistant to use by children. Its safety is good. Feelings in the use of this lighter are comfortable, injury to the user's finger may be avoided and the original function remains unchanged.

BRIEF DESCRIPTION OF DRAWINGS

The present invention will in more detail be described with reference to the drawings, in which.

DETAILED DESCRIPTION OF PREFERRED EMBODIMENT

Figure 1:
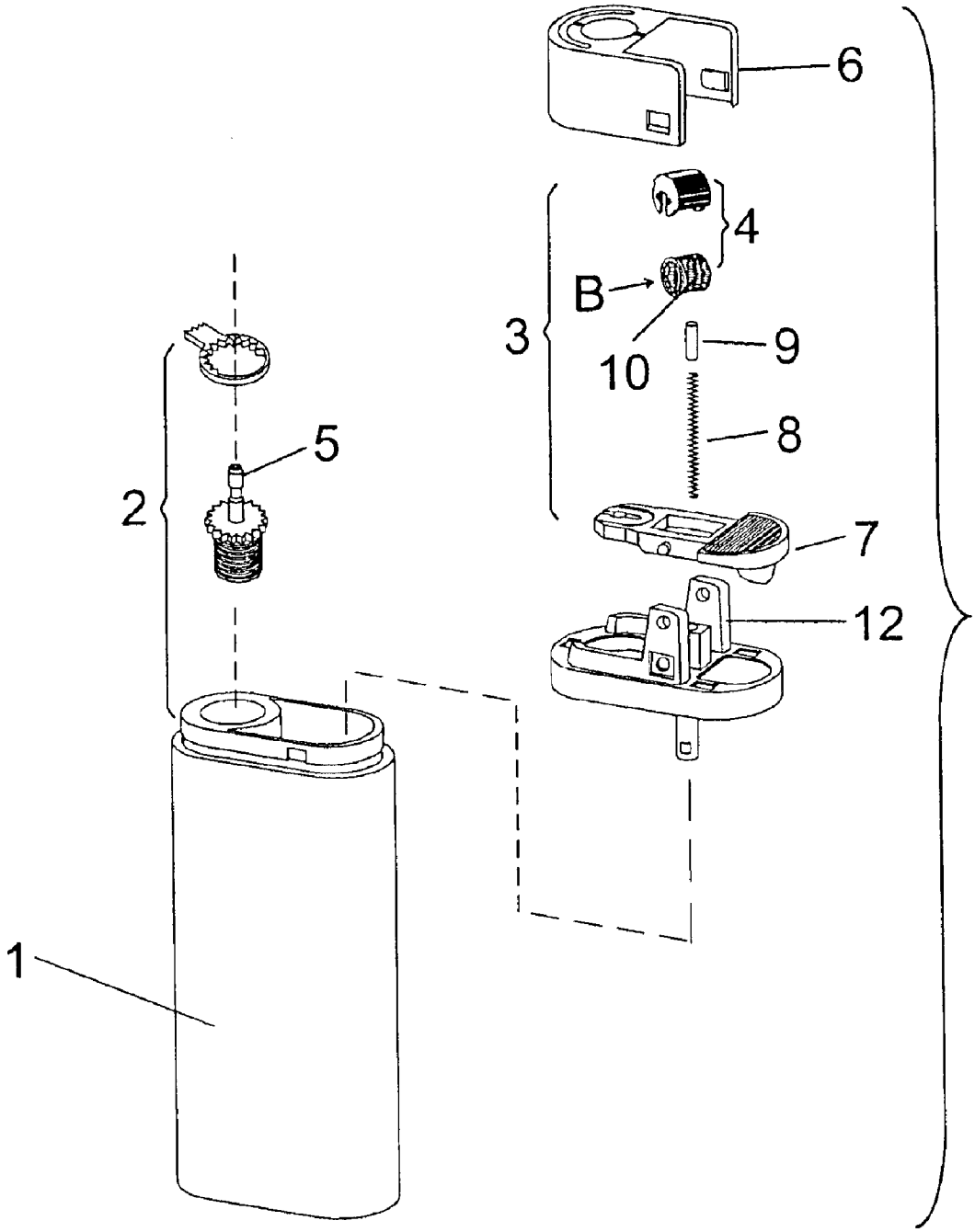
FIG. 1 is an exploded view of the lighter of the present invention.

Referring to FIG. 1, the safety gas lighter in accordance with the present invention mainly comprises a lighter body 1, a fuel supply means 2, an ignition means 3 which are all substantially conventional as well as a safety device 4. Fuel such as butane is contained in the lighter body 1. The fuel supply means 2 at a front and upper position of the lighter body 1 has a nozzle 5 for giving off gas upwards, which is surrounded by a windshield 6. Elevation of this nozzle 5 by means of an actuating lever 7 causes the gas flow path to open, i.e., gas is supplied. Returning of this nozzle 5 by means of a spring causes the gas flow path to close, whereupon the supply of gas is stopped. The ignition means 3 is located on a middle and upper portion of the lighter body 1 and includes flint spring 8, flint 9, spark wheel 10. Spark wheel 10 touches flint 9 closely under the action of the flint spring 8.

In normal operation, the spark wheel 10 is rotated and the rear of the actuating lever 7 is depressed virtually simultaneously, which causes the nozzle 5 to be raised and a spark to be created when the flint 9 is rubbed. The spark ignites the fuel and a flame is maintained so long as the rear of the lever 7 is continued to be depressed downward.

Figure 2:
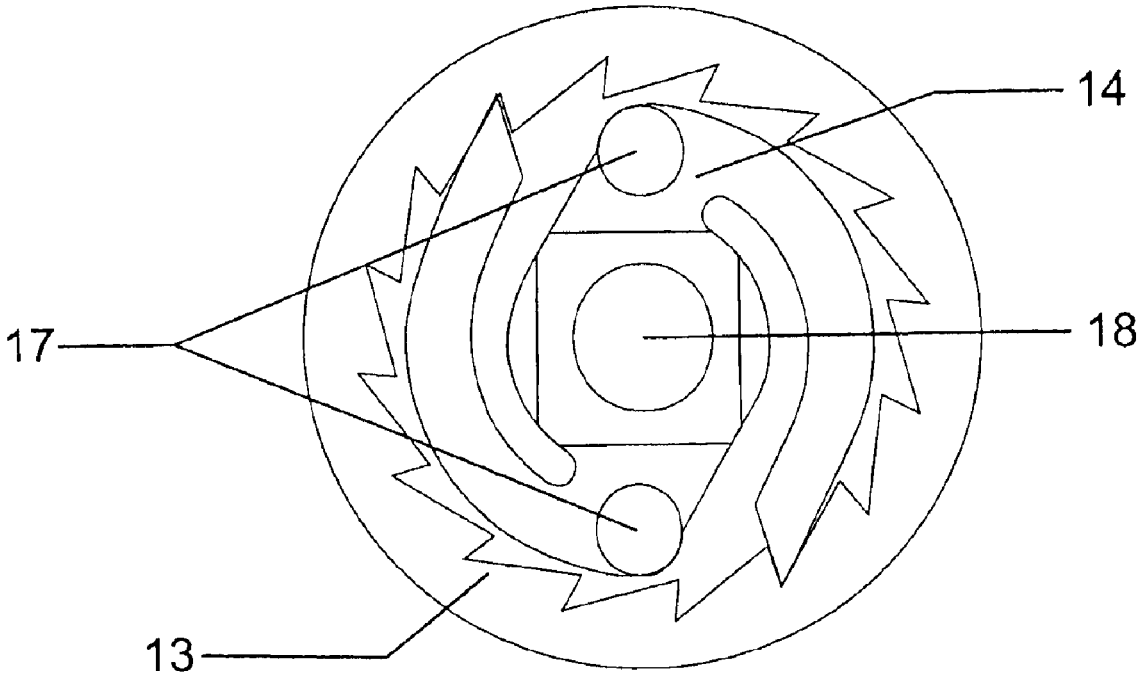
FIG. 2 is a side view of the ratchet-pawl mechanism of the present invention taken in the direction of the arrow B as shown in FIG. 1.
Figure 3:
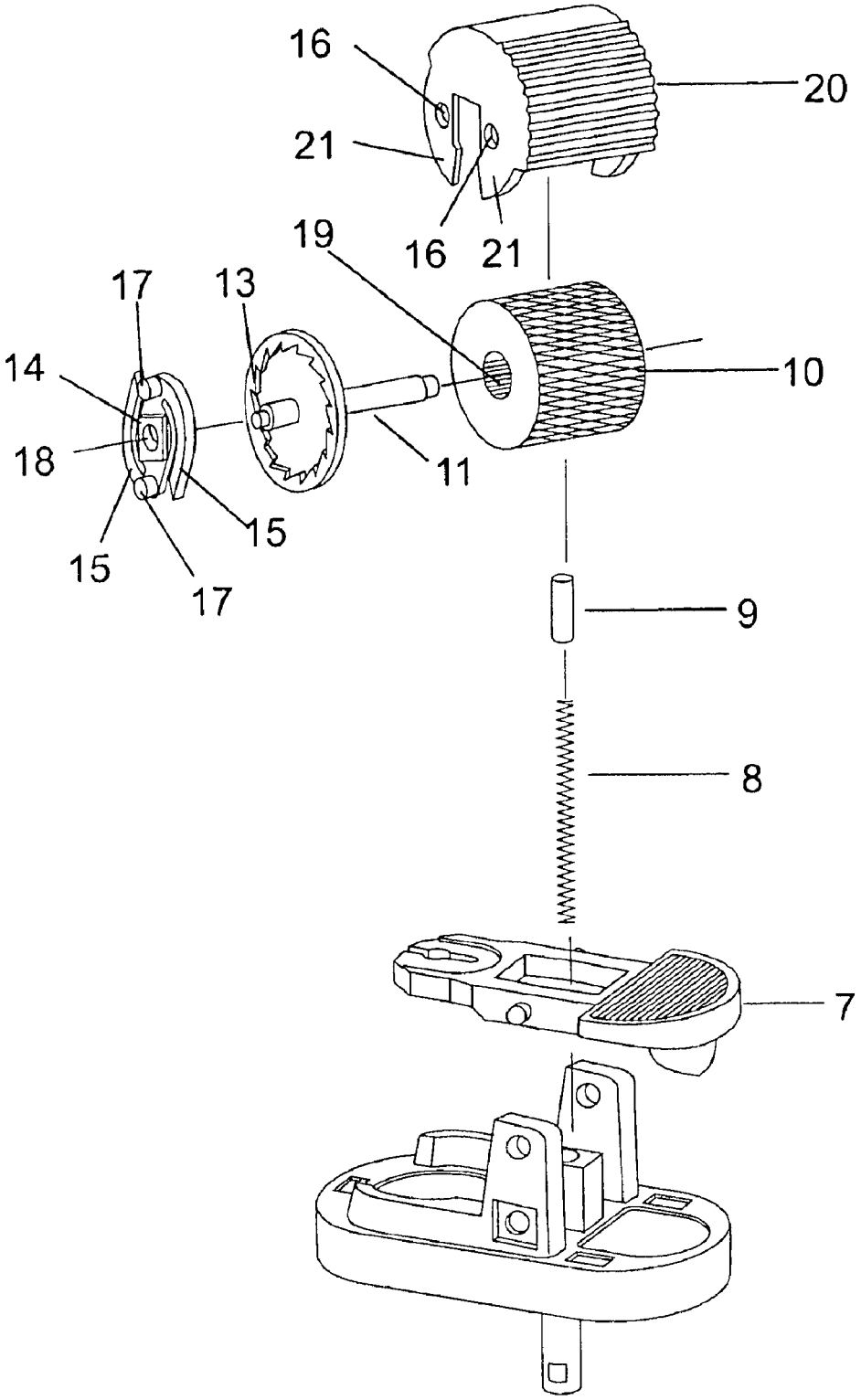
FIG. 3 is an exploded view of the ratchet-pawl mechanism of the present invention.

Referring to FIGS. 2 and 3, the safety device 4 comprises a pivoting axle 11 which is fixed to the mounting frame 12, an internal ratchet 13 which rotates together with the axle 11 and is attached to one side of the axle 11, a pawl member 14 which has engage pawls 15 and is selectively engaged with ratchet teeth of the ratchet 13, and a safety hood 20 which is installed by fitting coupling holes 16 over cylinders 17 protruding from the pawl member 14.

The pawl member 14 is in the form of "S" at the front and has two pawls 15. At the center portion of the pawl member 14, a hole 18 is established through which an end of the axle 11 is fitted. The internal ratchet 13 rotates together with the pivoting axle 11 and the both are integrally formed. Another end of the axle is inserted into the center hole 19 of the spark wheel 10 by means of compression force, whereby forming a close fit between both. Thus, the pawl member 14 and the internal ratchet 13 are attached while the internal ratchet 13 and the spark wheel 10 are side by side mounted. The internal ratchet 13 and the spark wheel 10 are covered by the safety hood 20 therein two opened legs of the safety hood 20 are fitted over two ends of the pivoting axle 11. At the same time, the safety hood 20 is installed by fitting coupling holes 16 over cylinders 17 of the pawl member 14. Besides, a portion of the top surface of the safety hood 20 is knurled. This knurling surface provides a gripping surface against which the user's thumb will rest.

Figure 4:
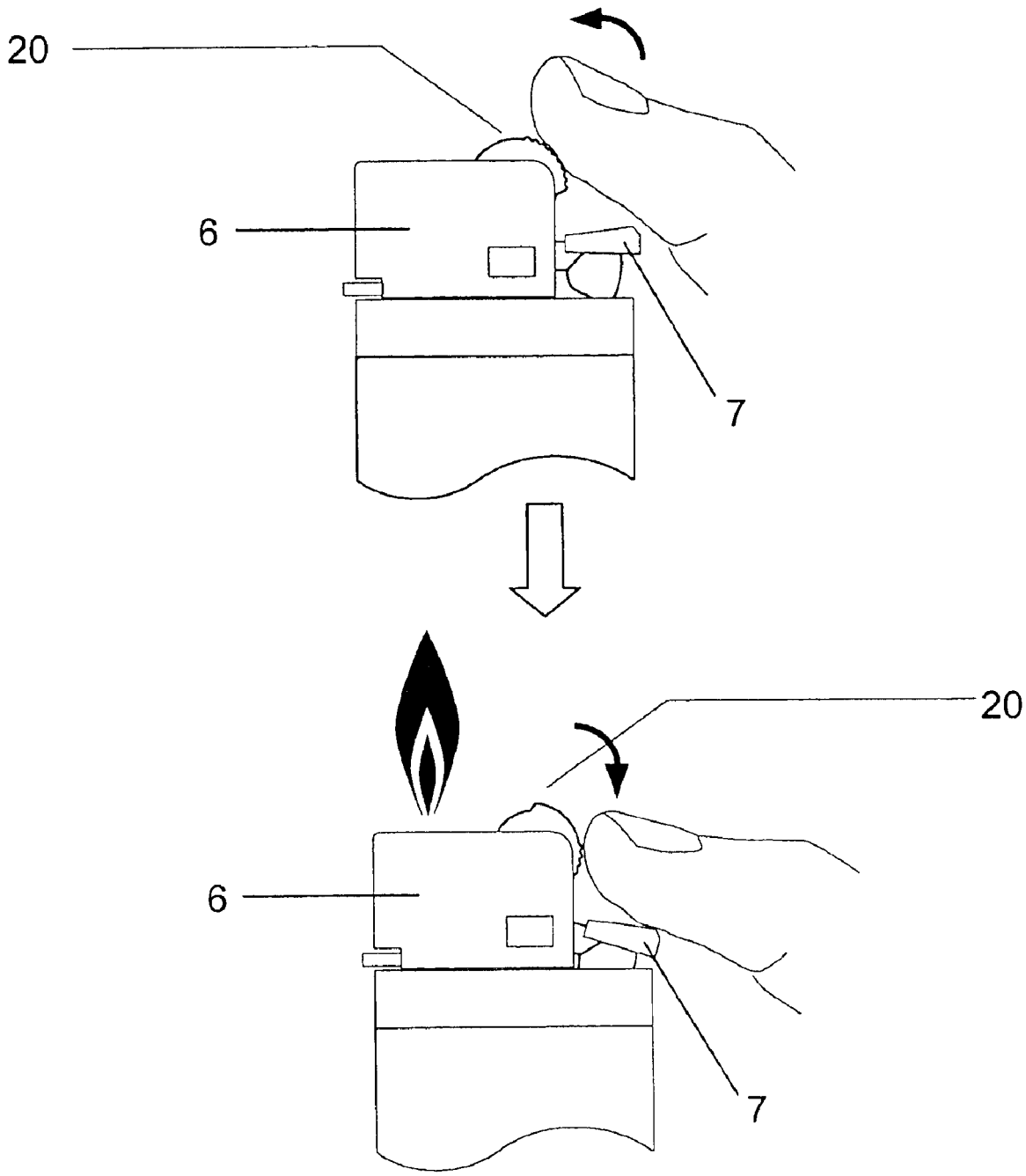
FIG. 4 is a schematic drawing of the lighter of the present invention showing how to use.

In use, as seen from FIG. 4, the safety hood 20, first of all, is moved up (the direction indicated by an arrow in FIG. 4) with the user's thumb. The rotation of the safety hood 20 causes the pawl 15 to rotate in the same direction via the projecting cylinders 17 of the pawl 15 and disengages the pawl 15 from the internal ratchet teeth of the ratchet 13.

To use the lighter, the user's thumb pressing on the safety hood 20 moves down, i.e., the safety hood 20 rotates in the reverse direction (in the direction of the arrow in FIG. 4). However, at this time, the spark wheel 10 cannot be actuated or rotated since the ratchet-pawl mechanism permits motion of the spark wheel 10 in only one direction. As the pawl 15 rotates, it engages with the ratchet teeth of the ratchet 13, thus rotating the pivoting axle 11. The rotation of the axle 11 rotates the spark wheel 10, so that the flint 9 elastically abutting on the spark wheel 10 is rubbed, producing sparks. The sparks ignite the vapor gas injected from the gas reservoir by means of pressing the rear end of acting lever 7 down by the user's thumb virtually simultaneously with the spark wheel 10 being actuated. Therefore, the present invention provides a very safety lighter for preventing any unexpected ignition of the lighter, especially preventing a playing and accidentally igniting of the lighter by children.

What is claimed is:

1. A safety gas lighter with a ratchet-pawl mechanism comprises:

a lighter body;

a fuel supply means positioned at a front and upper portion of the lighter body, including a gas reservoir contained in the lighter body and a nozzle for giving off gas upwards and a windshield proximate the nozzle;

an ignition means positioned at a middle and upper portion of the lighter body, including a flint for generating sparks which is retained via a spring in a flint retainer provided in the lighter body, a spark wheel rotatably mounted on a mounting frame formed at the top portion of the lighter body and engaging the flint, and an actuating lever coupled to the mounting frame; and a safety device comprising:

a pivoting axle fixed to the mounting frame;

an internal ratchet which rotates together with the pivoting axle and is attached to one side of the pivoting axle;

a pawl member which has engage pawls, is selectively engaged with ratchet teeth of the ratchet and has two cylinders protruding therefrom; and a safety hood, one side of which is installed by fitting coupling holes over the cylinders and one end of the pivoting axle and another side of which on another end of the pivoting axle;

wherein said safety hood is positioned above said actuating lever; and wherein ignition of the safety gas lighter is accomplished by gripping the safety hood and rotating it in a first, upward direction to disengage the pawl from the ratchet teeth, followed by rotation of the safety hood in a second, downward direction to engage the pawl with the ratchet teeth and rotate the pivoting axle and spark wheel, followed by depression of the actuating lever.

2. The safety gas lighter as claimed in claim 1, wherein said internal ratchet and said axle are integrally formed.

3. The safety gas lighter as claimed in claim 1, wherein said pawl member is in the form of"S".

* * * * *